United States Patent [19]

Glaser et al.

[11] 4,364,454

[45] Dec. 21, 1982

[54] VEHICLE DOOR LOCK FOR LIMITING DOOR OPENING TO SPECIFIED VEHICLE POSITIONS

[75] Inventors: Walter Glaser, Montvale; Herbert P. Glaser, Demarest, both of N.J.

[73] Assignee: G.A.L. Manufacturing Corporation, Bronx, N.Y.

[21] Appl. No.: 201,307

[22] Filed: Oct. 27, 1980

[51] Int. Cl.[3] ..... B66B 13/00

[52] U.S. Cl. ..... 187/57; 187/61; 49/116

[58] Field of Search ..... 187/49, 57, 61, 50, 187/52 LC, 56, 32, 31, 51; 49/404, 116, 31

[56] References Cited

U.S. PATENT DOCUMENTS

| | | | |
|---|---|---|---|
| 1,035,174 | 8/1912 | Edes | 187/61 |
| 1,119,001 | 12/1914 | Beardslee | 187/50 |
| 1,284,554 | 11/1918 | Armstrong | 187/50 |
| 1,959,042 | 5/1934 | Staley | 187/61 |
| 1,961,938 | 6/1934 | Norton | 187/52 LC |
| 2,003,399 | 6/1935 | Tamsitt | 187/52 LC |
| 3,056,470 | 10/1962 | Moser et al. | 187/61 |
| 3,625,312 | 12/1971 | Hutner | 187/57 |
| 3,912,049 | 10/1975 | Holland et al. | 187/61 |

FOREIGN PATENT DOCUMENTS

| | | |
|---|---|---|
| 468376 | 7/1937 | United Kingdom . |
| 1047977 | 8/1965 | United Kingdom . |
| 1213689 | 11/1970 | United Kingdom . |
| 1265989 | 3/1972 | United Kingdom . |

*Primary Examiner*—Stanley H. Tollberg
*Assistant Examiner*—Kenneth Noland
*Attorney, Agent, or Firm*—Brooks, Haidt, Haffner & Delahunty

[57] ABSTRACT

A locking mechanism, for the doors of an elevator car, which is disabled when the car is within a short distance from a landing but which otherwise permits the doors to be opened by an amount insufficient for a passenger to exit from the car and then locks the doors with respect to further opening movement. In the preferred form, a door carries a notched plate, and a latch bolt on a part of the car which is stationary relative to the door is controlled by an arm engageable with spaced cams in the hoistway so that the bolt will enter the notch of the plate when the car is away from a landing and the doors are partially opened.

26 Claims, 17 Drawing Figures

VEHICLE DOOR LOCK FOR LIMITING DOOR OPENING TO SPECIFIED VEHICLE POSITIONS

The invention relates to a door lock for a passenger carrying vehicle which prevents a passenger within the vehicle from opening the door or doors of the vehicle by an amount sufficient to permit the passenger to exit from the vehicle unless the vehicle is within a specified distance from a point at which the passengers normally leave the vehicle and in particular, relates to a locking mechanism for the doors of an elevator car which locks and prevents opening of the car doors by a passenger within a car by an amount sufficient to permit the passenger to exit from the car unless the car is close to a landing.

Although the invention has other uses, it will be described as applied to an elevator car.

It sometimes happens that the movement of an elevator car stops for various reasons, e.g. a power or control failure etc. If the car stops close to a landing where a passenger may exit from the car, there is no objection to permitting a passenger to force the car doors open manually since the landing doors may be opened, or are open, and the passenger may exit safely. However, if the floor of the car is a substantial distance from level with the landing floor, a passenger, while exiting from the car, may fall under the car into the hoistway. In the past, the car door was, on some elevators, held closed by keeping the door closing mechanism energized, but such expedient is not sufficient to prevent a passenger in the car from prying the door open. Also, with a power failure, the mechanism is no longer energized.

Recent elevator codes specify that the car or hoistway doors must be arranged so that they cannot be opened more than four inches from inside the car when the car is outside the landing zone, e.g. when the floor of the car is more than a short distance from being level with a landing floor. Such code also specifies that when the car door is so arranged, the car door shall be openable from outside the car without special tools for the purpose of rescuing the passengers within the car.

None of the prior art discloses apparatus which meets both these requirements, and while it may be possible to meet the requirements with retracting cams, electrical control circuits dependent upon the operation of other existing control circuits, etc., the latter expedients involve a substantial amount of equipment and system modification. Also, to avoid the noise and wear of a part striking a cam at each floor, it is desirable that any system for meeting the requirements avoid the use of a part which strikes a cam as the car moves in the hoistway.

One object of the invention is to provide a simple combination of parts which may be easily installed and which will prevent the opening of the door or doors of a passenger carrying vehicle by a passenger therein to an extent that a passenger can exit from the vehicle unless the vehicle is within a selected distance from a normal disembarkation point.

Another object of the invention is to provide a car door lock for an elevator car which will meet the elevator code specifications described hereinbefore.

A further object of the invention is to provide apparatus which not only accomplishes the aforesaid objects but also does not have parts which cause undesirable noise with movement of the vehicle.

The preferred embodiment of the invention is entirely mechanical, and the door can be opened from within the vehicle when the vehicle is near a disembarkation point. In other words, the locking mechanism of the preferred embodiment of the invention does not lock a door until a passenger within a vehicle moves the door a small amount and the vehicle is a pre-established distance from a normal disembarkation point. In the preferred embodiment of the invention, a keeper plate having a pair of teeth separate by a notch or gap is mounted on the vehicle door so as to move therewith. A lock bolt or latch which can fit into the notch is mounted on a rotatable shaft mounted on another portion of the vehicle so that when the door is closed, the bolt rests on top of the tooth farther from the door edge. When the door is opened, the bolt moves into the notch and engages a side of the other tooth unless an arm which is also mounted on the rotatable shaft engages a cam located adjacent the path of travel of the vehicle. The length of the cam in the direction of travel of the vehicle is such that the bolt cannot enter the notch when the vehicle is within a short distance from the normal disembarkation point, i.e. the landing zone. Thus, the door will operate normally and can be opened from interiorly of the vehicle when the vehicle is a specified distance from the normal disembarkation point but can be opened only a small amount when the vehicle is more than the specified distance from such point.

In another embodiment, the lock bolt is mounted in a fixed position on the vehicle door, and the notched plate is mounted on another portion of the vehicle and is operated by the shaft-arm-cam combination previously described to provide the same results.

In a further embodiment of the invention, the lock bolt of the first-described embodiment is operable by an electrically energizable solenoid on the vehicle which is controlled by a switch on the vehicle which is operable by either the shaft-arm-cam combination or is controlled by a magnetically operable switch on the vehicle which is operable by plates on the hoistway. In both cases, a separate power supply which can energize the solenoid when the main electrical power has failed is carried by the vehicle.

Other objects and advantages of the present invention will be apparent from the following detailed description of the presently preferred embodiments thereof, which description should be considered in conjunction with the accompanying drawings in which.

Figure 1:
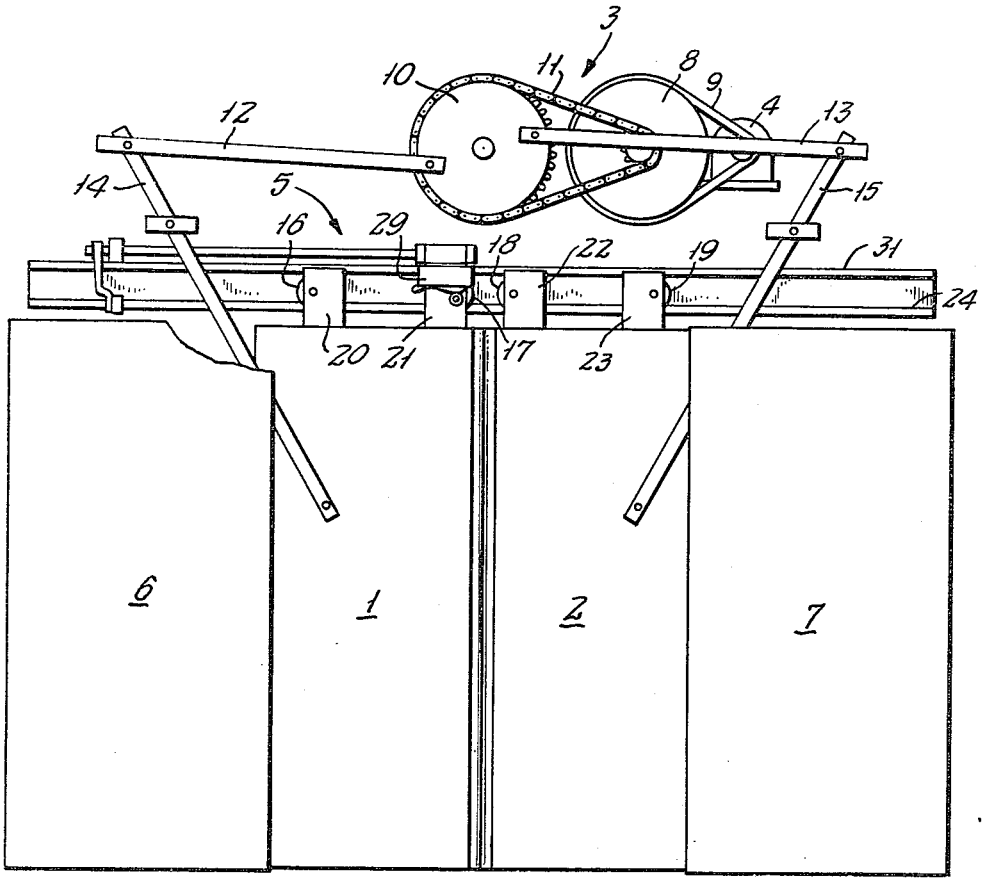
FIG. 1 is a schematic, elevation view, from the landing side, of a typical elevator car door installation, the hoistway doors being opened and the door locking apparatus of the invention being installed on the car and car door.
Figure 2:
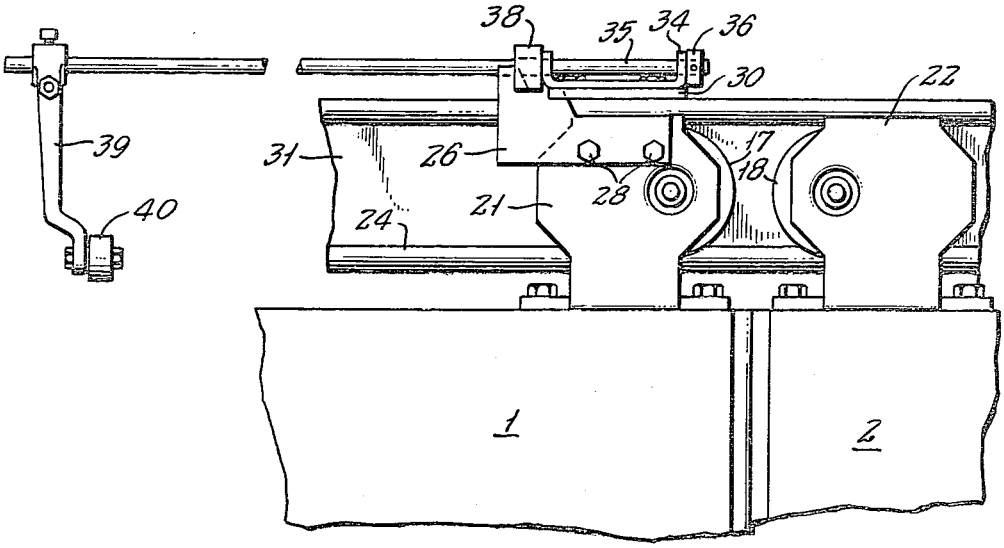
FIG. 2 is a front elevation, enlarged view of a portion of the apparatus shown in FIG. 1.
Figure 3:
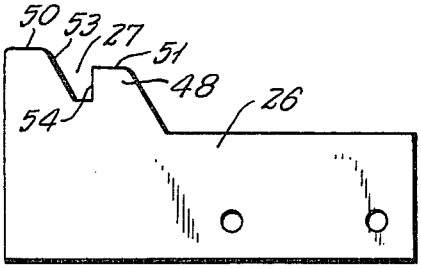
FIG. 3 is an enlarged, front elevation view of a notched plate forming part of the preferred apparatus of the invention.

FIG. 1 illustrates a known type of elevator installation which comprises a pair of sliding or reciprocable car doors 1 and 2 which are opened and closed by a door operating mechanism 3. Although the invention is applicable to other types of installations, the installation may be of the type manufactured and sold by G.A.L. Manufacturing Corporation, 50 East 153rd Street, Bronx, New York. The installation illustrated in FIG. 1 comprises an electric motor 4 which is energized by a controller (not shown), which separates the doors 1 and 2 when the car 5 is at a landing and which brings the doors 1 and 2 together when the car 5 departs from a landing. The hoistway doors, which are operated in a conventional manner, are not visible in FIG. 1 since they have been opened, the hoistway doors being hidden by walls 6 and 7 at the landing.

A reversible motor 4 drives a pulley 8 by means of a belt 9, and the pulley 8 drives a gear wheel 10 through a chain 11. By means of links 12 and 13 and pivotable levers 14 and 15, the doors 1 and 2 are opened and closed under the control of the controller. It is to be noted that because of the interconnection of the doors 1 and 2 by the links and levers 12–25, the locking of one door in a position will also prevent opening of the other door. Therefore, with the installation illustrated it is necessary to lock only one door when it is desired to prevent passengers from exiting from the car 5. However, if the doors 1 and 2 are not so interconnected, the apparatus of the invention may be applied to both doors.

Sometimes, after the doors 1 and 2 are closed, as shown in FIG. 1, the motor 4 remains energized in the door closing directions so that a substantial force is required to separate the doors 1 and 2 manually. However, the doors 1 and 2 can be pried apart even with such energization of the motor 4, and if the motor 4 is deenergized, such as by reason of a power or control failure, the doors 1 and 2 may be manually separated relatively easily.

The doors 1 and 2 are supported by circumferentially grooved wheels 16–19 rotatably mounted on hangers 20–23 secured to the doors 1 and 2. The wheels 16–19 ride on a rail 24 secured to the car 5.

As pointed out hereinbefore, one objective of the invention is to lock the doors 1 and 2 with respect to manual opening thereof when the car 5 is more than a safe distance, e.g. outside the landing zone, from a landing or floor. This could be accomplished by a detent mechanism which operates when the doors are closed and locks the doors in their fully closed positions. However, such a detent mechanism must be controlled by the control circuits of the installation, requiring wiring and other modifications, or by a cam mechanism which requires striking of a cam by a cam follower when the car approaches the landing, causing undesirable noise and wear. In the preferred embodiments of the invention, the doors 1 and 2 are not locked until they are separated manually by a small amount, e.g. four inches, and there is no striking of a cam follower against a cam as a floor or landing is approached or passed by the car 5.

The locking apparatus of the invention may take various forms, as described hereinafter, but in the preferred forms illustrated in FIGS. 1–10, only mechanical parts are used, and such parts may be easily installed on new or existing elevator installations without modification of the conventional or installed equipment used in an elevator system.

In the preferred embodiments of the invention illustrated in FIGS. 1–10, a plate 26 (see FIGS. 2 and 3) having an aperture therein in the form of a notch 27 is secured to the hanger 21, such as by bolts 28. It is preferred that the plate 26 be secured to the hanger 21 because, in the installation described, the hanger 21 already carries a bracket to which a control switch 29 (see FIG. 1) is secured and the mountings for such brackets may be used to mount a portion of the apparatus of the invention. Also, it is preferred to mount the apparatus of the invention as near as possible to the leading edge of the door 1 to which manual opening force would be applied. However, if desired, the plate 26 may be mounted on the other hanger 20, or on some other part of a door 1 so as to move with the door on which it is mounted.

A bracket 30 (see FIGS. 2, 6 and 7), which may be a modified form of the bracket used to support the switch 29, is secured to the channel 31, such as by bolts 32, which has the rail 24 and an upper rail 33. The bracket 30 has a U-shaped support 34 secured thereto in any desired manner, and the support 34 rotatably supports a rotatable shaft 35. A collar 36 is secured to one end of the shaft 35 preventing movement of the shaft 35 to the left as viewed in FIGS. 2, 6 and 7. The bracket 30 has a cut-out 37 for receiving a portion of the plate 26.

A lock bolt 38 is secured to the shaft 35 so as to move with the shaft 35. The bolt 38 prevents movement of the shaft 35 to the right as viewed in FIGS. 2, 6 and 7. An arm 39 is secured to the shaft 35 so that movement of the arm 39 causes rotation of the shaft 35, and the arm 39 carries a cam follower in the form of a rotatable roller 40.

Figure 8:
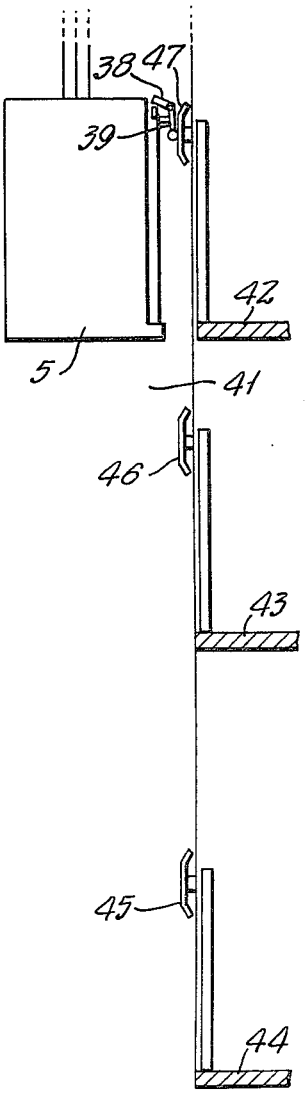
FIG. 8 is a schematic, side elevation view illustrating an elevator car in a hoistway.
Figure 7:
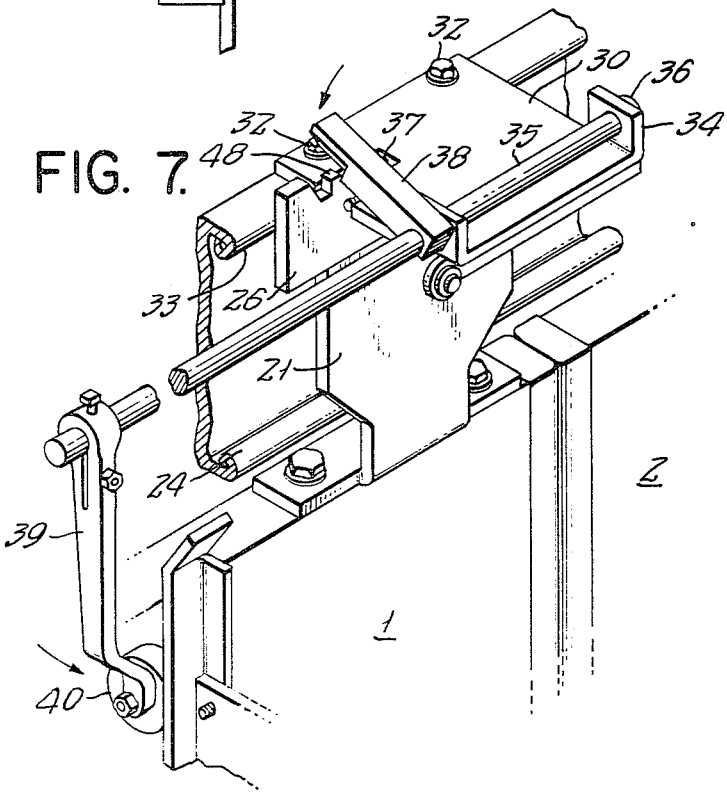
FIG. 7 is a perspective view of a portion of the apparatus shown in FIG. 2.

FIG. 8 schematically illustrates the car 5 in a hoistway 41, the car 5 being movable in a conventional manner between a plurality of floors or landings 42–44, etc. In FIG. 8, the floor of the car 5 is level with the landing 42, and when the floor of the car 5 is close to level with a landing, the locking apparatus of the invention is disabled in the manner described hereinafter. However, when the floor of the car 5 is more than a predetermined distance from level, e.g. outside the landing zone which may, for example, have a length from a few to several inches in the direction of the movement of the car 5, the locking apparatus of the invention is not disabled and is effective to lock the doors 1 and 2 after they have been separated by a small amount, e.g. one to four inches.

The locking apparatus of the invention is disabled, in the embodiments illustrated in FIGS. 1–10, by cams 45–47, etc., one for each floor or landing, which are engagable by the cam follower 40 as the doors 1 and 2 are opened at a landing. When the floor of car 5 is not within a predetermined distance of a landing the follower 40 cannot engage a cam 45, 46 or 47, etc. and the bolt 38 enters into the notch 27 when the doors 1 and 2 are forced open. When the bolt 38 enters the notch 27 further movement of the door 1 to the left, as viewed in FIGS. 1, 2, 6 and 7, and hence, further movement of the door 2 to the right, is prevented by reason of the engagement of the bolt 38 with a side of the projection or tooth 48 (FIG. 3) on the plate 26. The length of the cams 45–47, etc. in the direction of movement of the car 5 is small relative to the distances between the floors 42–44, etc. and is selected so as to define the zone in which the locking apparatus is disabled and the distance between floors that the locking apparatus is operative. In other words, the length of the cams 45–47, etc. is selected so that the locking apparatus locks the doors 1 and 2 against movement by an amount which would permit a passenger in the car 5 to exit from the car 5 when the floor of the car 5 is more than a predetermined safe distance from level with a landing. The length of the cams 45–47, etc. may, for example, be on the order of ten inches but may, if desired, be more or less than ten inches. Generally speaking, the length of the cams 45–47, etc. is at least equal to the length necessary to permit the doors 1 and 2 to open in elevator systems which commence the opening of the doors 1 and 2 shortly in advance of the time when floor of the car 5 becomes level with a landing and is not large enough to permit a gap of more than about 18 inches between the floor of the car 5 and a landing floor when an attempt is made to separate the doors 1 and 2 manually.

The plate 26 has a surface 50 (FIG. 3) which is farther from the bottom of the notch 27 than the surface 51 of the projection 48. The plate 26, and hence, the surface 50, are positioned relative to the bolt 38 so that the lower surface of the bolt 38 engages the surface 50 when the doors 1 and 2 are fully closed. The arm 39 is adjusted in the direction circumferentially of the axis of the shaft 35 so that the roller 40 is slightly spaced from a cam 45, 46 or 47, etc. when the bolt 38 rests on the surface 50. Of course, the cams 45–47, etc. may be made adjustable toward and away from the car 5 so that the roller 40 is slightly spaced from each cam when the bolt 38 rests on the surface 50. By such adjustment of the parts, the roller 40 does not strike a cam as the car 5 approaches a landing and the noise of the striking of a cam follower against a cam is avoided. Also, since roller 40 does not strike a cam, no parts move thereby eliminating unnecessary wear.

However, the position of the parts, i.e. cams and arm, are also adjusted in relation to the surface 51 so that when the car 5 is at a landing and the doors 1 and 2 are opened, the roller 40 engages a cam and prevents the bolt 38 from entering the notch 27, i.e. maintains the lower surface of the bolt 38 at or above the level of the surface 51. In this way, the locking apparatus of the invention is disabled when the floor of the car 5 is within a predetermined distance from a landing, and the doors 1 and 2 may be opened in the normal manner or manually.

Figure 5:
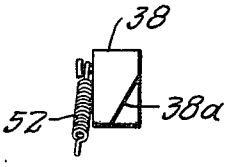
FIGS. 4 and 5 are, respectively, front elevation and end elevation views of a lock bolt forming part of the preferred apparatus of the invention.
Figure 4:
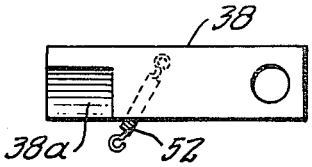
Figure 6:
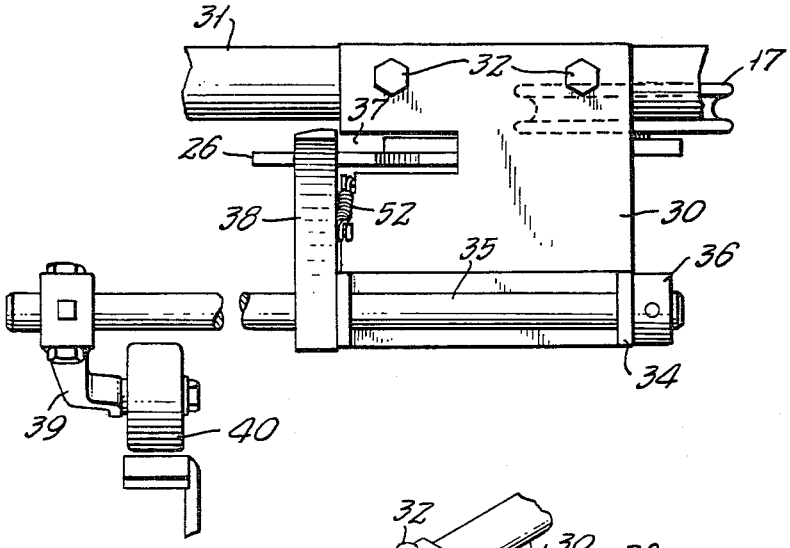
FIG. 6 is a plan view of a portion of the apparatus shown in FIG. 2.

With the foregoing in mind, let it be assumed that the parts of the locking apparatus of the invention have been properly adjusted as described and that the car 5 arrives at the landing 42 with its doors 1 and 2 closed. At this point, the bolt 38 rests on the surface 50 and is urged thereagainst by a spring 52 (FIGS. 4–6). In approaching the landing 42, the roller 40 did not strike the cam 47 because the engagement of the bolt 38 with the surface 50 maintained the roller 40 in spaced relation to the cam 47. The doors 1 and 2 are then opened by the conventional control apparatus, and as the door 1 moves to the left, carrying the plate 26 with it, the bolt 38 rides off the surface 50 and commences to move toward the notch 27. However, such movement of the bolt 38 toward the notch 27 is arrested by engagement of the roller 40 with the cam 47 at a position such that with continued movement of the door 1 to the left, the surface 51 passes under the bolt 38. Accordingly, opening of the doors 1 and 2 in the normal manner is not prevented.

When the car door 1 and 2 thereafter close, the surface 51 of the plate 26 again passes under the bolt 38, and the sloping surface **38*a* of the bolt 38 (FIGS. 4 and 5) engages the sloping surface 53 of the plate 26 causing the bolt 38 to move upwardly at its free end and onto the surface 50. During such movement of the bolt 38, the shaft 35 rotates and moves the roller 40 away from the cam 47 where it remains as long as the doors 1 and 2 are closed. Therefore, if the other cams are properly adjusted, the roller 40 will not strike them as the car 5 arrives at the various landings. Striking, with its noise, is to be distinguished from the relatively noiseless engagement of the roller 40 with a cam when the bolt 38 leaves the surface 50**.

Let it now be assumed that the car 5 is at a position in the hoistway 41 where the roller 40 cannot engage a cam 45–47, etc., and for some reason, e.g. power or control failure, the car 5 stops. If an attempt is then made by a passenger within the car to force the doors 1 and 2 apart, the doors 1 and 2 will separate until the locking means or bolt 38 moves into the notch 27 of the stop means or plate 26 and engages the surface 54 (FIG. 3) of the projection 48. The doors 1 and 2 can then not be separated further. The spacing between the surface 50 and the surface 54 as well as the position of the bolt 38 relative to the right end of the surface 50, as viewed in FIG. 3, determines the amount that the doors 1 and 2 can be separated further. As previously mentioned, the doors 1 and 2 should become locked at least by the time the separation therebetween reaches about four inches. However, to provide the feature of absence of the noise of a cam follower (roller 40) striking a cam (45–47), etc.), the doors 1 and 2 are permitted to separate by an amount sufficient to allow for the bolt 38 to rest on the surface 50 and to ride thereoff and thereby, to produce the movement of the roller 40 away from and toward a cam.

It will be apparent from the foregoing that the locking apparatus or latching means of the invention requires relatively few and relatively inexpensive parts and that it may be installed in an elevator system, either existing or new, relatively easily. Also, the apparatus may be installed in an elevator system without any substantial modification of the conventional apparatus of an elevator system, including the control apparatus.

Furthermore, the doors 1 and 2 of the car may be released from outside the car 5 without the use of special tools, it being merely necessary to lift the bolt 38 or to depress cam follower 40, manually. The locking apparatus of the invention is also inaccessible to a passenger within the car 5 even when the doors 1 and 2 are opened by the permitted amount.

Of course, when normal operation of the elevator car resumes, the locking apparatus of the invention will operate as described without any resetting of its parts.

Figure 9:
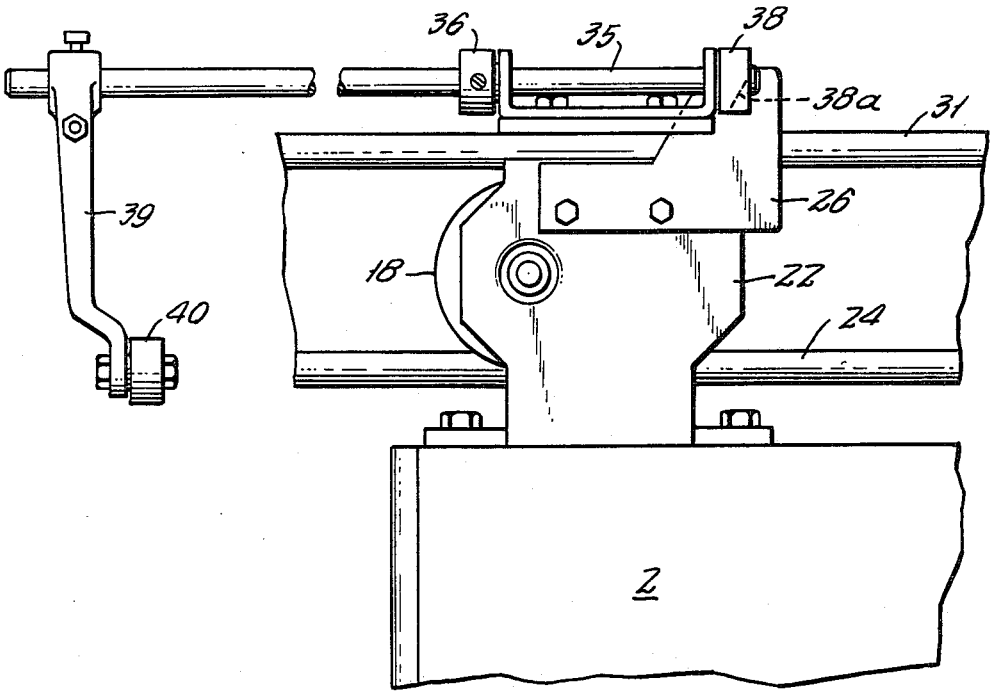
FIG. 9 is similar to FIG. 2 but illustrates the notch plate of the apparatus of the invention installed on a different car door.
Figure 10:
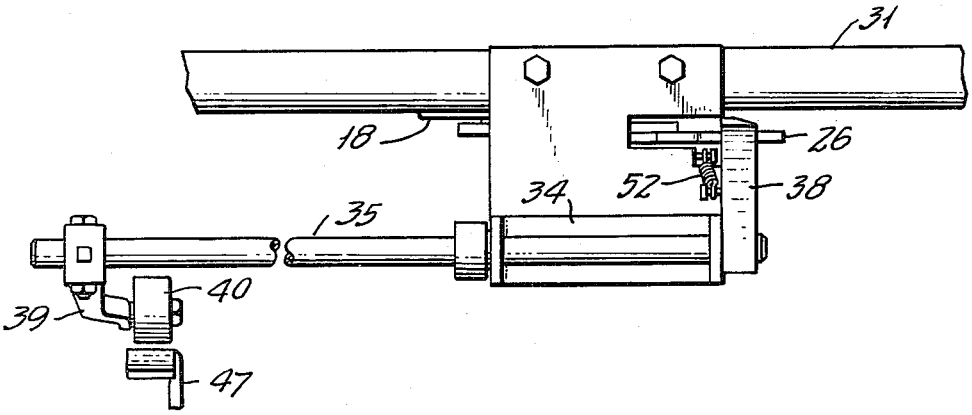
FIG. 10 is a plan view of the apparatus shown in FIG. 9.

If desired, the stop means or plate 26 may be mounted on the door 2 rather than the door 1 as illustrated in FIGS. 9 and 10 by mere reversal of some of the parts and substitution of a locking bolt 38 having an oppositely sloping face 38*a*. The operation of the locking apparatus is the same as that described hereinbefore.

In some cases, the noise of a cam follower striking a cam in a hoistway may be tolerable, particularly if the follower need not exert a substantial mechanical force to operate a lock bolt. In such cases, it is possible to interconnect the cam follower with the lock bolt by an electrical circuit including a solenoid for operating the lock bolt. However, in such cases, it is desirable to have a stand-by electrical power supply on the elevator car which can energize the solenoid in the event of a main power supply failure, both to permit operation of the bolt and release of the doors from externally of the car and to permit release of the doors when a car is moved to a landing while the main power supply is still inoperative. The use of an electrical circuit to interconnect the cam follower with the lock bolt has the advantage of being installable in cases where there are obstructions which do not permit the installation of the locking apparatus of FIGS. 1–10.

Figure 11:
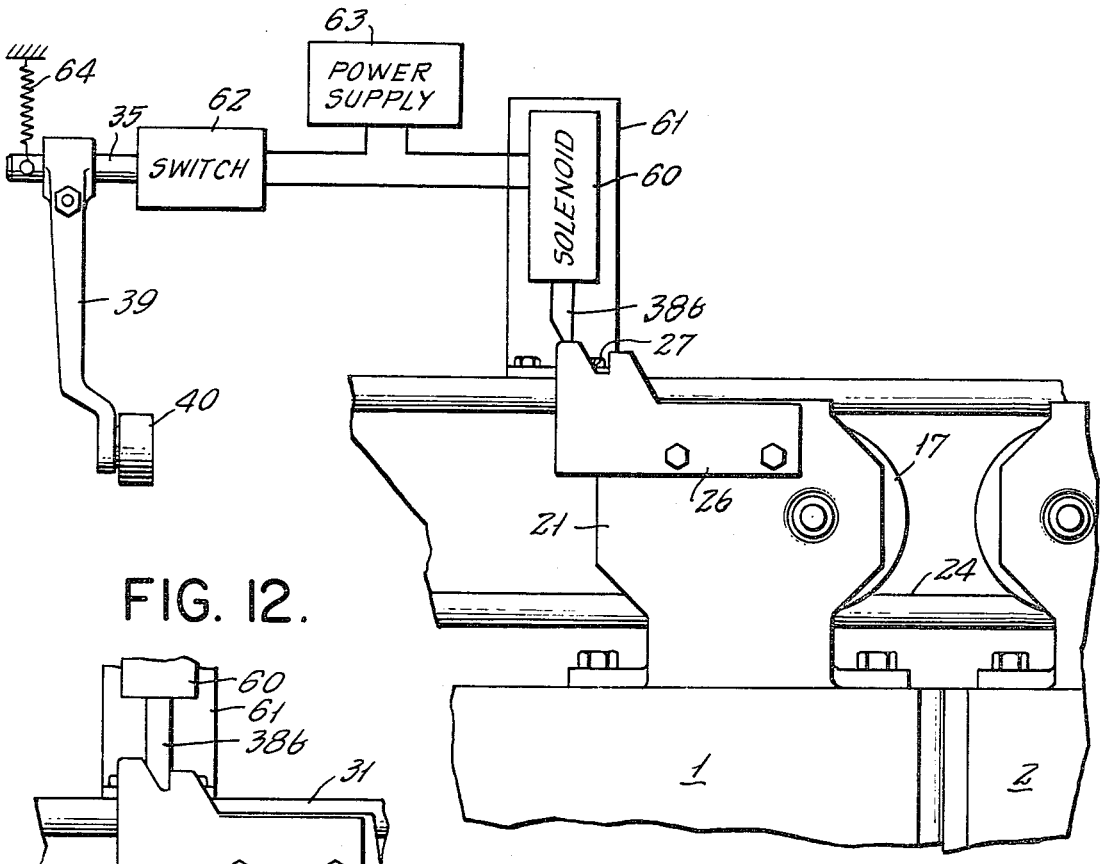
FIG. 11 is partly a plan view and partly a schematic diagram of an alternative embodiment of the invention in which the lock bolt is operated by a solenoid.
Figure 12:
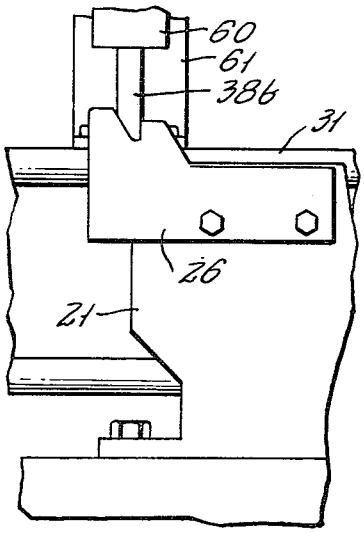
FIG. 12 is an elevation view of a portion of the apparatus shown in FIG. 11 and illustrates the relative position of the parts after the car door has been partly opened.

FIG. 11 illustrates an electrical circuit for connecting the cam follower or roller 40 and the lock bolt 38*b* which is movable by the field of a solenoid 60 mounted on a simple bracket 61 secured to the channel 31. The plate 26 is the same as the plate 26 previously described and is mounted on the hanger 21 in the same manner. FIG. 11 illustrates the relative positions of the bolt 38*b* and the plate 26 when the doors 1 and 2 are closed, and FIG. 12 illustrates their relative positions when the solenoid 60 is not energized and the doors 1 and 2 are prevented from opening further.

The electrical circuit for connecting the roller 40 and the lock bolt 38*b* includes, in addition to the solenoid 60, a switch 62 operable when the shaft 35 is rotated and a power supply 63. The switch 62 is in circuit with the power supply 63 and the solenoid 60 for energizing the solenoid 60, and thereby either retracting, or preventing downward movement of, the bolt 38*b*, when the roller 40 engages a cam 45–47, etc. In this arrangement, the arm 39 is adjustable relative to the movement of the contacts of the switch 62 and to the cams 45–47, etc. so that when the car 5 approaches a landing, the roller 40 engages the cam associated with the landing and closes the controls of the switch 62. When the roller 40 is in between the cams of two landings, the shaft 35 is rotated by a spring 64 to cause the contacts of the switch 62 to open.

Accordingly, when the floor of the car 5 is within a predetermined, safe distance of a landing, the solenoid 60 is energized, and the bolt 38*b* cannot enter into the notch 27 of the plate 26 when the doors 1 and 2 are opened, the door 1 moving to the left, as viewed in FIG. 11, as the doors are opened. On the other hand, when the roller 40 is not in engagement with a cam 45–47, etc., the contacts of the switch 62 are open and the solenoid 60 is not energized. Therefore, when the door is then moved to the left, the bolts 38*b* moves into the notch 27, as shown in FIG. 12, and prevents further opening of the doors 1 and 2.

Figure 13:
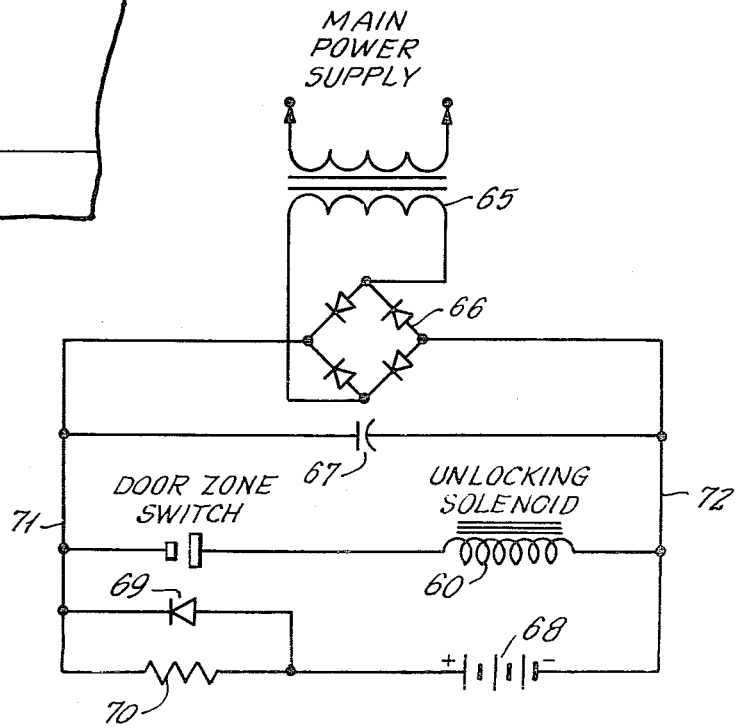
FIG. 13 is a circuit diagram for the apparatus shown in FIGS. 11 and 12.

FIG. 13 is a circuit diagram of one form of stand-by power supply 63 and circuit which may be mounted on the car 5 to energize the solenoid 60 in the event of failure of the main power supply. The power supply 63 comprises a transformer 65 connected to the main power supply, a bridge rectifier 66, a capacitor 67, a battery 68, a rectifier 69 and a resistor 70. The contacts of the switch 62 are connected in series with the solenoid 60 between the power supply lines 71 and 72 so that the battery 68, which is maintained charged by the main power supply, can energize the solenoid 60 in the event that the supply of electrical power from the main power supply is interrupted.

In the embodiment illustrated in FIGS. 11 and 12, it is possible to eliminate the shaft 35, the arm 39, the roller 40 and the cams 45–47, etc. if there are contacts on the conventional controller which are closed only when the car 5 is within the landing zone and if they close whether or not there is a power failure. Thus, the contacts of the switch 62 shown in FIG. 13 would be replaced by such contacts of the controller. This modified embodiment would eliminate any noise which may be caused by the striking of a cam 45–47, etc. by the roller 40 but requires the availability of contacts on the controller to replace the switch 62 and electrical wiring from the controller to the power supply 63 and the solenoid 60.

Another way to eliminate any noise which may be caused by the roller 40 striking a cam on the hoistway is to eliminate the shaft 35, the arm 39, the roller 40 and the cams 45–47, etc. and to substitute a magnetically operable switch for the switch 62. Such a magnetically operable switch is well-known in the art and closes its contacts when a magnetic member is brought close thereto. One type of such a magnetically operable switch is known as a Type LU switch and is manufactured and sold by the G.A.L. Manufacturing Corporation identified hereinbefore.

Figure 14:
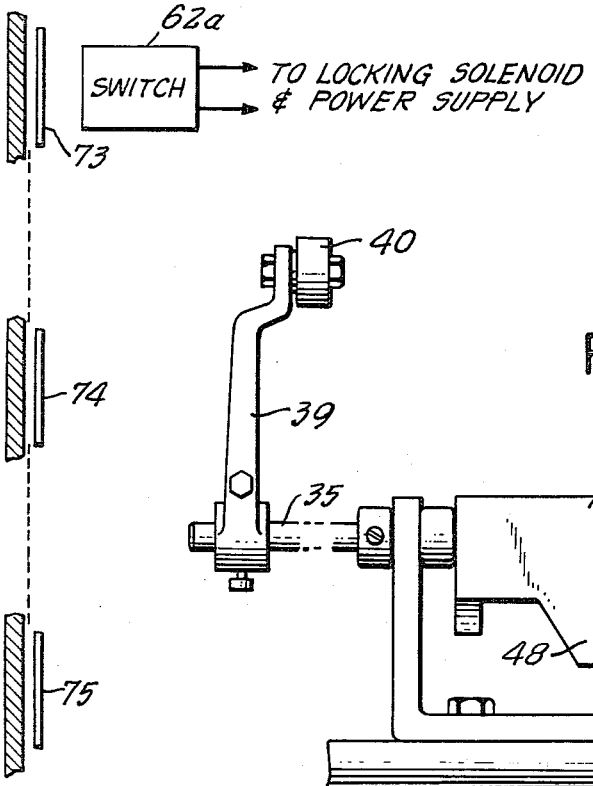
FIG. 14 is a schematic diagram illustrating an alternative embodiment in which the switch illustrated in FIGS. 11 and 12 is magnetically rather than mechanically operated.

FIG. 14 illustrates schematically an embodiment in which a magnetically operable switch 62*a* is substituted for the mechanically operable switch 62, the shaft 35, the arm 39 and the roller 40, and the cams 45–47, etc. are replaced by magnetic members 73–75, etc. mounted on a side of the hoistway so that the switch 62*a* is actuated when the floor of the car 5 is within a predetermined, safe distance of a landing. The members 73–75, etc. accomplish the functions of the cams 45–47, etc., and are selected in the same manner as the cams 45–47, etc. to cause energization or deenergization of the solenoid 60 in accordance with the position of the car 5. However, it is not necessary that the switch 62*a* engage a member 73, 74, 75, etc. to cause closing of the contacts of the switch 62*a*. Mere proximity of a member 73–75, etc. to the switch 62*a* is sufficient to close the contacts.

Figure 15:
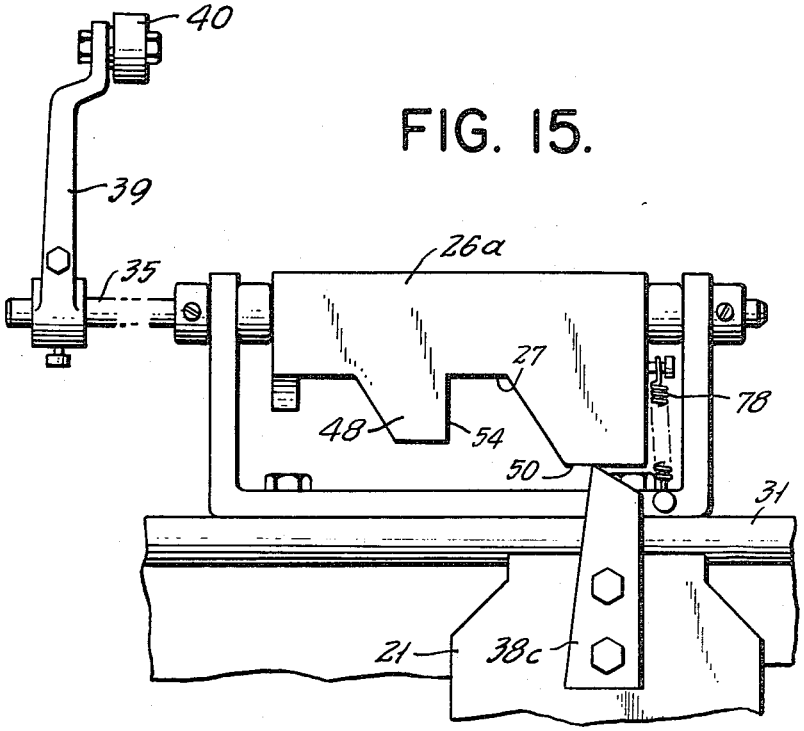
FIG. 15 is a fragmentary, front elevation view illustrating an alternative embodiment of the invention.
Figure 16:
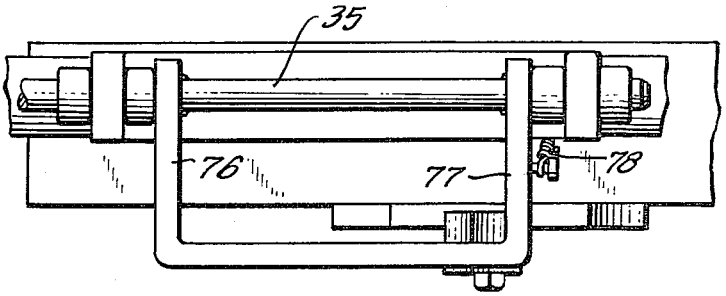
FIG. 16 is a plan view of the apparatus illustrated in FIG. 15.

In the embodiments illustrated in FIGS. 1–10, the plate 26 is on a car door and the bolt 38 or 38*a* is on another portion of the car 5, i.e. the rail 31. FIGS. 15 and 16 illustrate a modified plate 26*a* mounted on the car rail 31 and a lock bolt 38*c* mounted in a fixed position on the hanger 21 of the car door 1.

In FIGS. 15 and 16, a plate 26*a* having a pair of extensions 76 and 77 is secured at the extensions 76 and 77 to the shaft 35 so as to rotate therewith. The surface 50 of the plate 26a is urged toward the end of the bolt 38c by a spring 78, FIGS. 15 and 16 showing the positions of the parts when the doors 1 and 2 are closed. The arm 39 and the cams 45–47, etc. are adjusted as described in connection with FIGS. 1–10 so that when the end of the bolt 38c engages the surface 50 of the plate 26a, the roller 40 is slightly spaced from the cam surfaces. When the car 5 is at a landing and the car doors 1 and 2 are opened, the operation of the locking apparatus is as described in connection with FIGS. 1–10, the engagement of the roller 40 with a cam preventing the bolt 38c from entering the notch 27. Similarly, when the floor of the car 5 is not within a predetermined, safe distance of a landing and the doors 1 and 2 separate by a small amount, the shaft 35 rotates an amount sufficient to pivot the surface 54 of the projection 48 into the path of the bolt 38c preventing further opening of the doors 1 and 2. Of course, because of the engagement of the bolt 38c with the surface 50 when the doors are closed, the roller 40 will not strike the cams 45–47, etc. when the car 5 moves with its doors closed.

Figure 17:
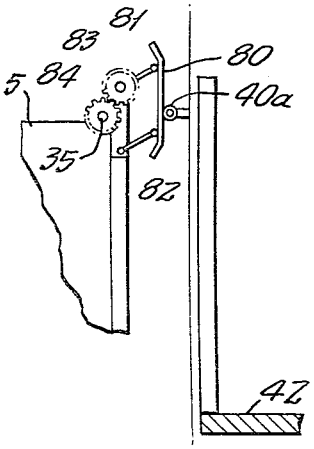
FIG. 17 is a schematic diagram of an alternative arrangement of the cam and roller used in the embodiment shown in FIGS. 1–10.

In the embodiment illustrated in FIGS. 1–10, the roller 40 is on an arm 39 secured to the shaft 36 which actuates the bolt 38, the roller 40 being carried by the car 5 and the cams 47, etc. being mounted in fixed positions on the hoistway wall. If desired, the cams may be replaced by a series of rollers 40a, one for each floor, and the arm 39 and the roller 40 may be replaced by a pivotally mounted cam 80 which is mounted on the car 5 as illustrated in FIG. 17. The cam 80 acts in the same manner as the arm 39 and the roller 40 and is pivotally mounted at the ends of a pair of arms 81 and 82, the opposite end of which are pivotally mounted on the car 5. The arm 81 rotates a gear 83 which engages a gear 84 secured to the shaft 35 described in connection with FIGS. 1–10. The purpose of the gears 83 and 84 is to translate the motion of the cam 80 into the correct direction of rotation of the shaft 35 for the actuation of the bolt 38, but it will be apparent that the mechanical devices other than gears may be employed to obtain the correct direction of rotation of the shaft 35.

Although preferred embodiments of the present invention have been described and illustrated, it will be apparent to those skilled in the art that various modifications may be made without departing from the principles of the invention.

What is claimed is:

1. In a passenger transportation system in which a passenger carrying vehicle moves along a selected path and stops at predetermined points to permit passengers to exit from said vehicle, said vehicle having a door thereon which travels therewith and which opens to permit the exiting of passengers from the vehicle, the combination therewith of:

latching means carried by said vehicle and acting between the door and another portion of the vehicle for permitting opening of said door by a predetermined amount less than the amount required for a passenger to exit from the vehicle and for preventing opening of said door by more than said predetermined amount; and control means which is responsive to the position of said vehicle, which is connected to said latching means and which disables said latching means when said vehicle is within a predetermined distance from a said point and thereby permits said vehicle door to open more than said predetermined amount when said vehicle is within a predetermined distance from a said point, said distance being small relative to the distances between said points.

2. A system as set forth in claim 1 wherein said latching means is inaccessible to a passenger within said vehicle and is accessible from externally of said vehicle whereby said latching means may be manually disabled from externally of said vehicle.

3. A system as set forth in claim 1 or 2 wherein said latching means comprises stop means on one of said door and said another portion of said vehicle and locking means on the other of said door and said another portion of said vehicle engageable with disengageable from said stop means, one of said stop means and said locking means being connected to said control means for causing movement of the means connected thereto and thereby preventing engagement of said locking means with said stop means.

4. A system as set forth in claim 3 wherein said control means comprises a plurality of cam means, one at each end of said points, cam engaging means on said vehicle for engaging said cam means when said vehicle is within said predetermined distance of said point and interconnecting means interconnecting said cam engaging means and said one of said stop means and said locking means.

5. A system as set forth in claim 4 wherein said interconnecting means is a rotatable shaft on which said one of said stop means and said locking means is mounted and said cam engaging means is an arm extending from said shaft for rotating said shaft.

6. A system as set forth in claim 4 wherein said interconnecting means comprises a switch operable by said cam engaging means, an electrical source, and a solenoid for actuating said one of said stop means and said locking means, said switch being in circuit with said source and said solenoid for energizing said solenoid when said cam engaging means engages said cam means.

7. A system as set forth in claim 3 wherein said control means comprises a plurality of members of magnetic material, one at each of said points, magnetically operable switch means on said vehicle operable by a member of said plurality of members when the switch means is adjacent thereto, an electrical source and a solenoid for actuating said one of said stop means and said locking means, said switch being connected in circuit with said source and said solenoid for energizing said solenoid when said switch is adjacent one of said members.

8. A system as set forth in claim 1 or 2 wherein said vehicle is an elevator car mounted for movement in a hoistway between a plurality of floors, said car having a door which opens to permit the exiting of passengers at each of said floors, said floors corresponding to said points, wherein said latching means comprises a latch bolt on one of said door and another portion of said car and a latching plate with an aperture thereon on the other of said door and said another portion of said car, said bolt being receivable in said aperture in said plate for preventing opening of said door and one of said bolt and said plate being movable with respect to the other thereof, and wherein said control means is connected to the one of said bolt and said plate which is movable for holding said latter one out of said aperture.

9. A system as set forth in claim 8 wherein said door is reciprocable and said plate is mounted on said door for movement therewith, wherein said control means comprises a shaft rotatably mounted on said another portion of said car, a plurality of cams, one mounted at each of said floors and each of said cams having a length in the direction of the length of the hoistway which is small relative to the distance between said floors, and an arm on said shaft for rotating said shaft and engageable with said cams and wherein said bolt is mounted on said shaft for movement therewith and into and out of said aperture.

10. A system as set forth in claim 9 wherein said plate has a surface which engages said bolt when said door is closed and which maintains said bolt, and hence, said shaft, in a position which prevents engagement of said arm with said cams when said door is closed.

11. A system as set forth in claim 8 wherein said door is reciprocable and said latch bolt is mounted on said door for movement therewith, wherein said control means comprises a shaft rotatably mounted on said another portion of said car, a plurality of cams, one mounted at each of said floors and each of said cams having a length in the direction of the hoistway which is small relative to the distance between said floors, and an arm on said shaft for rotating said shaft and engagable with said cams and wherein said plate is mounted on said shaft for movement therewith and thereby moving the aperture into position for receiving said bolt.

12. A system as set forth in claim 11 wherein said plate has a surface which engages said bolt when said door is closed and which maintains said plate, and hence, said shaft, in a position which prevents engagement of said arm with said cams when said door is closed.

13. A system as set forth in claim 8 wherein said door is reciprocable, said plate is mounted on said door for movement therewith and said latch bolt is movably mounted on said another portion of said car and wherein said control means comprises a switch, a power supply and a solenoid mounted on said car, said solenoid being coupled to said bolt for movement thereof into and out of said aperture and said switch being in circuit with said power supply and said solenoid for energizing the latter, and switch operating means, including means at each of said floors, for operating said switch when said car is within said predetermined distance from a floor.

14. A system as set forth in claim 13 wherein said switch operating means comprises a plurality of cams, one at each floor and each cam having a length in the direction of the hoistway which is small relative to the distance between floors, a shaft rotatably mounted on said car and connected to said switch for operation of the latter with rotation of the shaft, and an arm mounted on said shaft for rotation of the latter, said arm being engagable with said cams.

15. A system as set forth in claim 13 wherein said switch is operable by magnetic members and wherein said switch operating means comprises a plurality of magnetic members, one at each floor, each member having a length in the direction of the hoistway which is small relative to the distance between floors and each member being positioned in the hoistway so as to operate said switch when the car is within said predetermined distance from a floor.

16. A system as set forth in claim 1 wherein said latching means is ineffective for maintaining said door in its closed position, and in the absence of disabling by said control means, is operated by movement of the door by said predetermined amount to prevent further opening of said door.

17. A system as set forth in claim 16 wherein said latching means comprises a pair of members, one of said members being mounted on said door for movement therewith and the other of said members being mounted on said vehicle, one of said members having a stop and the other of said members being a latch which is normally engageable with said stop when said door is opened by said predetermined amount, but said members being held in relative positions when said door is closed such that said latch would not engage said stop when said door is opened if the said members are held in said relative positions.

18. Apparatus adapted to be installed in an elevator system comprising an elevator car mounted for movement in a hoistway between a plurality of floors, said car having a door thereon which moves therewith and which opens to permit the exiting of passengers at each of said floors, said apparatus comprising a shaft, an arm which can be secured to said shaft for pivoting the latter, a notched plate, a lock bolt, means for rotatably mounting said shaft on a portion of said car other than said door and in a position such that, with said arm thereon, said arm is outwardly of said car, means for mounting said plate on one of said door and said shaft, means for mounting said lock bolt on the other of said door and said shaft in a position to engage said plate, and cam means mountable on said hoistway at a floor for engagement with said arm and thereby limiting rotation of said shaft.

19. Apparatus as set forth in claim 18 wherein said means for mounting said plate is means for mounting said plate on said door and said means for mounting said lock bolt is means for mounting said bolt on said shaft.

20. Apparatus as set forth in claim 19 wherein said plate has a bolt receiving notch intermediate a pair of projections, the endmost surfaces of said projections being at different distances from the bottom of said notch.

21. Apparatus as set forth in claim 18 wherein said means for mounting said plate is means for mounting said plate on said shaft and said means for mounting said lock bolt is means for mounting said bolt on said door.

22. Apparatus as set forth in claim 21 wherein said plate has a bolt receiving notch intermediate a pair of projections, the endmost surfaces of said projections being at different distances from the bottom of said notch.

23. In an elevator system which comprises an elevator car which is mounted for movement in a hoistway between a plurality of floors, said car having a door thereon which travels therewith and which opens to permit passengers to exit from the car, electrically operable means for moving said car between floors and for opening and closing said door and an electric power supply for supplying electrical power to said electrically operable means, the combination therewith of:

latching means carried by said car and acting between said door and another portion of said vehicle for preventing opening of said door by more than a predetermined amount, said latching means being operated by movement of said door toward the open position and being operable even in the event of failure of said power supply; and control means responsive to the position of said car and connected to said latching means for preventing and latching means from preventing opening of said door when said car is within a predetermined distance of a floor, said distance being small relative to the distance between said floors, and said control means being operable even in the event of failure of said power supply.

24. A system as set forth in claim 23 wherein said control means is free from contact with means mounted in a fixed position on said hoistway except at a floor where the car stops to discharge a passenger from the car.

25. A system as set forth in claim 23 or 24 wherein said latching means is ineffective to prevent the opening of said door prior to movement of said door from its closed position by a predetermined distance.

26. In an elevator system which comprises an elevator car which is mounted for movement in a hoistway between a plurality of floors, said car having a door therein which travels therewith and which opens to permit passengers to exit from the car, the combination therewith of:

latching means carried by said car and acting between said door and another portion of the vehicle for preventing opening of said door by an amount sufficient to permit a passenger to exit from the car, said latching means comprising interengageable stop means and locking means, one of said stop means and said locking means being mounted on said door and the other of said stop means and said locking means being mounted on another portion of said car; and control means which is responsive to the position of said car and which is connected to one of said stop means and said locking means for preventing interengagement thereof when said car is within a predetermined distance of a said floor to thereby permit said door to open by an amount sufficient to permit a passenger to exit from the car, said control means comprising operating means on said car and connected to said last-mentioned one of said stop means and said locking means and means at each of said floors engageable with said operating means when said car is within said predetermined distance of said floor and said door moves toward its open position for positioning said last-mentioned one of said stop means and said locking means so that said stop means and said locking means cannot interengage as the door opens.

* * * * *

UNITED STATES PATENT AND TRADEMARK OFFICE

CERTIFICATE OF CORRECTION

PATENT NO. : 4,364,454

DATED : December 21, 1982

INVENTOR(S) : Walter Glaser et al

It is certified that error appears in the above—identified patent and that said Letters Patent is hereby corrected as shown below:

Col. 9, line 23, change "36" to --35--

Col. 11, line 21, after "direction" insert --of the length--.

Signed and Sealed this

*Fifteenth* Day of *March 1983*

[SEAL]

*Attest:*

GERALD J. MOSSINGHOFF

*Attesting Officer*

*Commissioner of Patents and Trademarks*